United States Patent [19]

Sato

[11] 4,290,042

[45] Sep. 15, 1981

[54] CONTROLLER FOR ELECTRIC MOTOR

[75] Inventor: Yoshitoshi Sato, Sukagawa, Japan

[73] Assignee: Yamamoto Electric Industrial Co., Ltd., Sukagawa, Japan

[21] Appl. No.: 60,870

[22] Filed: Jul. 26, 1979

[30] Foreign Application Priority Data

Aug. 30, 1978 [JP] Japan ..... 53-105291

[51] Int. Cl.[3] ..... H01C 10/12

[52] U.S. Cl. ..... 338/113; 338/108; 338/153

[58] Field of Search ..... 338/108, 113, 52, 49, 338/101, 153; 74/512, 560, 515

[56] References Cited

U.S. PATENT DOCUMENTS

| | | | |
|---|---|---|---|
| 2,371,772 | 3/1945 | Naul | 338/108 |
| 2,536,012 | 12/1950 | Turner | 338/52 |
| 2,850,605 | 9/1958 | Matthias | 338/113 X |
| 3,353,424 | 11/1967 | Peterson et al. | 74/560 |
| 3,427,545 | 2/1969 | Tanzman | 338/108 |
| 3,703,693 | 11/1972 | Nomura et al. | 338/108 |

*Primary Examiner*—C. L. Albritton

*Attorney, Agent, or Firm*—Armstrong, Nikaido, Marmelstein & Kubovcik

[57] ABSTRACT

A controller for electric motors comprises a casing, a carbon pile resistor contained in a through hole of an insulating frame carried by the casing, a U-shaped spring conductor plate with an end secured to the insulating frame, a rotational plate pivotally supported on the casing, a first terminal connected to an end of the carbon pile resistor, and a second terminal connected to the conductor plate. The other end of the conductor plate is operatively connected to the rotational plate. Thus the other end of the conductor plate is biased and presses the other end of the carbon pile resistor in response to the rotation of the rotational plate.

5 Claims, 16 Drawing Figures

CONTROLLER FOR ELECTRIC MOTOR

BACKGROUND OF THE INVENTION

1. Field of the Invention

The present invention relates to a controller for an electric motor circuit, or more in particular to a controller having a carbon pile rheostat used to control the starting, stopping and speed of an electric motor.

2. Description the Prior Art

A controller of this type is generally suitable for controlling the motor for an electric sewing machine and so constructed that the resistance value of the carbon pile rheostat is changed by manually swinging the rotational plate. Conventional controllers of this type are disclosed in U.S. Pat. Nos. 3,353,424, 2,536,012, etc. These conventional controllers have a complicated construction, are low in the workability of assembly and high in cost.

SUMMARY OF THE INVENTION

Accordingly, it is an object of the present invention to obviate the above-mentioned disadvantages of the conventional controllers.

FIGSS. 6A and 6B are plan and side views respectively of a conductor plate 5.

Figure 7B:
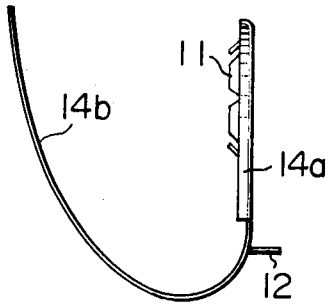
Figure 7A:
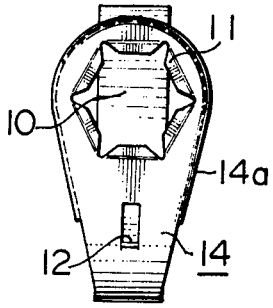
Figure 7C:
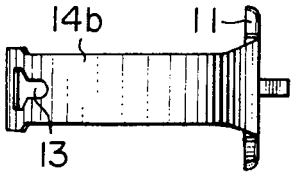

FIGS. 7A, 7B and 7C are plan, side and bottom views respectively of a conductor plate 14.

Figure 8C:
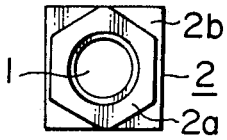
Figure 8A:
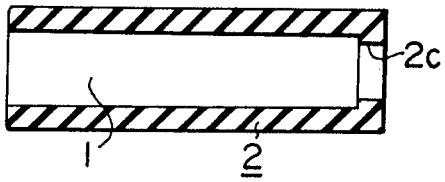
Figure 8B:
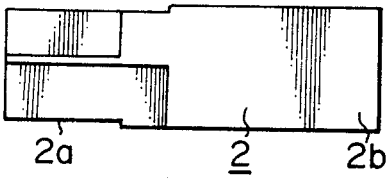

FIGS. 8A, 8B and 8C are longitudinal sectional, side and front views respectively of an insulating frame.

DETAILED DESCRIPTION OF THE PREFERRED EMBODIMENTS

Figure 1:
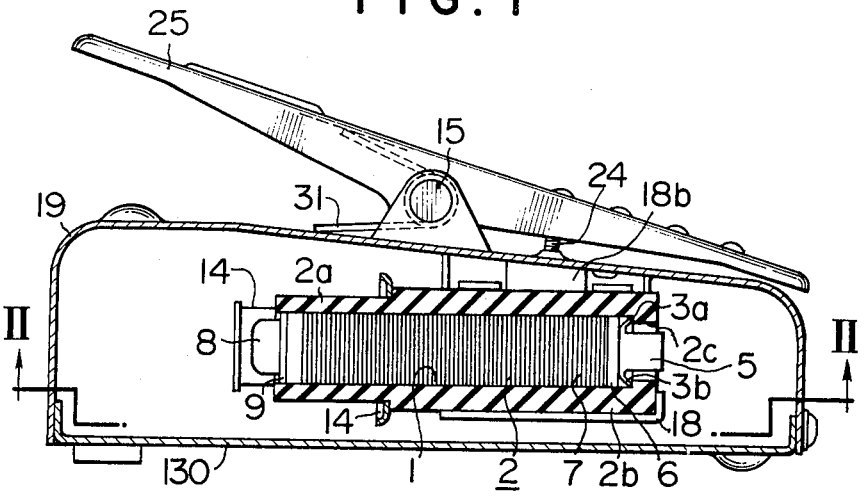
FIG. 1 is a longitudinal sectional view of an embodiment of the controller according to the present invention.

The diagram of FIG. 1 is a cross sectional view cut away at the center of the covers 19 and 130 showing a typical embodiment of the speed controller of a motor according to the present invention. The diagram of FIG. 2, on the other hand, is a bottom view of the speed controller of FIG. 1 with the cover (chassis) 130 removed, which is taken along the line II—II in FIG. 1. By the way, the diagram of FIG. 1 is a view taken along the line I—I in FIG. 2.

Figure 6A:
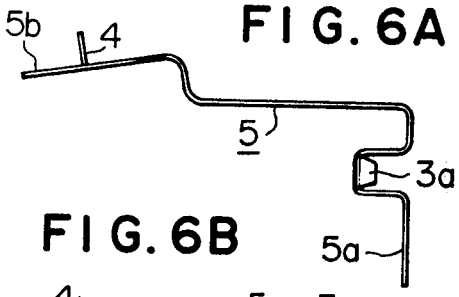
Figure 6B:
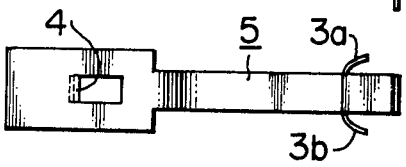

Reference numeral 2 shows a ceramic insulating frame having a cylindrical through hole 1. In the drawing, the left portion 2*a* of the insulating frame 2 has an outline of polygonal shape such as a hexagonal shape or circle, while the right portion 2*b* thereof has an outline of a polygonal shape such as a square. Longitudinal sectional, side and front views of the insulating frame 2 are shown in FIGS. 8A, 8B and 8C respectively. A step 2*c* is formed at the right end of the inside wall forming the through hole 1 of the insulating frame. A conductor plate 5 is an elastic metal plate acting as a short-circuit plate, the plan view and side view thereof are shown in FIGS. 6A and 6B respectively. In FIGS. 6A and 6B, two portions of the U-shaped part of the conductor plate 5 are bent to provide bent pieces 3*a* and 3*b*, while one end portion thereof has a rise portion 4. The U-shaped part of the conductor plate 5 is inserted into a through hole 1 of the insulating frame 2 in such a manner that the forward ends of the bent pieces 3*a* and 3*b* are engaged in the recess of the step 2*c*. Since the bent pieces 3*a*, 3*b* of the conductor plate 5 have an elasticity, the bent pieces are prevented from being removed from the recess, and therefore the conductor plate 5 is fixedly held by the insulating frame 2.

The other end portion 5*a* of the conductor plate 5 is connected with a terminal 30*a* of a lead wire 30 which is in turn connected to a speed control circut of a motor not shown. A thick carbon disc 6 is inserted from the part 2*a* side of the through hole 1. Then, a multiplicity of thin carbon discs 7 are inserted. A carbon tappet 8 is inserted, followed by insertion of an elastic circular stop ring 9 in a manner to hold the carbon discs 6 and 7 within the through hole. In this way, a carbon pile resistor is formed between the tappet 8 and the conductor plate 5.

A conductor plate 14 is fitted over the outer surface of the rectangular part 2*a* of the insulating frame 2. Plan, side and bottom views of the conductor plate 14 are shown in FIGS. 7A, 7B and 7C respectively. In FIGS. 7A, 7B and 7C, the conductor plate 14 has a U shape. One end part 14*a* of the conductor plate 14 is formed with a hexagonal or other polygonal aperture 10. A plurality of engaging raised portions 11 are formed along the periphery of the aperture 10. A raised portion 12 is provided for connecting a lead wire 30. The other side 14*b* of the conductor plate 14 has a cut-out strip 13. The aperture 10 of the conductor plate 14 is fitted over the outer periphery surface of the rectangular part 2*a* of the insulating frame 2 and pressed into the position. The conductor plate 14 is fixedly held on the insulating frame 2 by the elastic action of the raised portions 11.

Figure 5A:
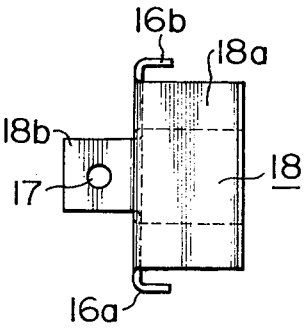
FIGS. 5A and 5B are plan and side views respectively of a holder.
Figure 5B:
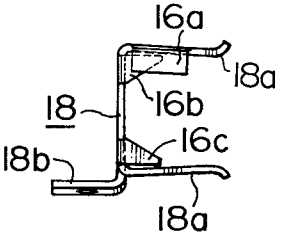

Front and side views of a holder 18 for holding the insulating frame 2 are shown in FIGS. 5A and 5B respectively. The holder 18 has a U-shaped bent portion 18*a* and an L-shaped mounting portion 18*b* at the other side. Further, the holder 18 includes engaging portions 16*a*, 16*b* and 16*c* and a screw mounting hole 17. The insulating frame 2 is held in pressed contact by the U-shaped bent portion 18*a*.

Figure 4B:
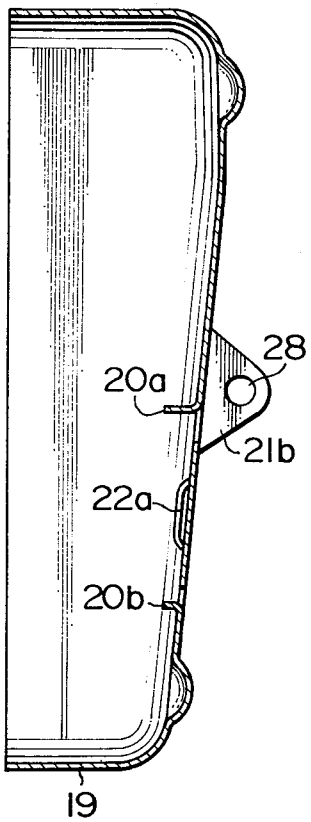
FIGS. 4A and 4B are plan and longitudinal sectional views respectively of the cover of the controller shown in FIG. 1.
Figure 4A:
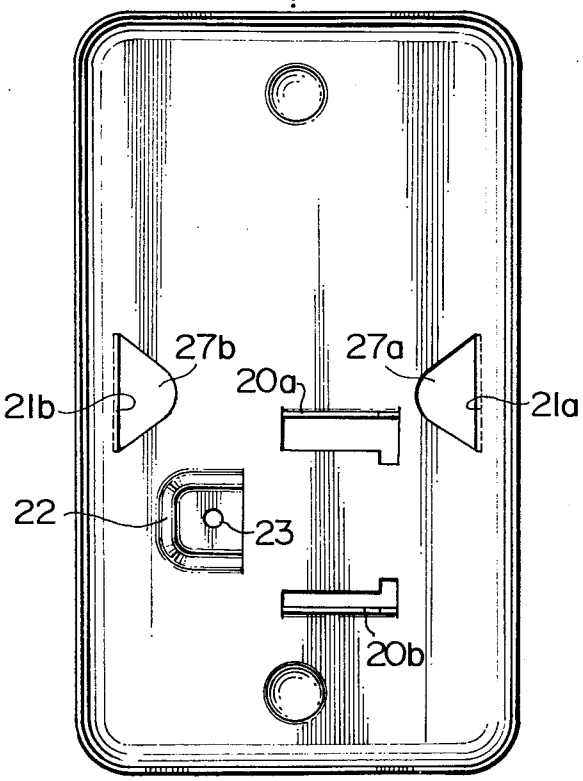

A cover 19 has a shape as shown by the front and longitudinal sectional views of FIGS. 4A and 4B respectively. The sectional view taken along the line IV-B—IVB in FIG. 4A is shown in FIG. 4B. The cover 19 includes rise portions 20*a* and 20*b*, raised portions 21*a* and 21*b* each having a hole 28 for receiving a shaft 15 for pivotally supporting the foot pedal or a rotational plate 25, and an extruded part 22 for accomodating the mounting part 18*b* of the holder 18. The extruded part 22 has a screw hole 23. The insulating frame 2 fixed by the holder 18 is placed on the lower parts of the raised portion 20*a* or 20*b*, and the mounting part 18*b* is inserted into the extruded part 22 so that the mounting hole 17 of the mounting part 18*b* is held against the screw hole 23, thus securing the mounting part 18*b* on the cover 19 and the extruded part 22 with a screw 24.

The foot pedal 25 has a long mounting arm 26 which is inserted into the cover 19 from a hole 27*a* formed by raising the upper surface of the cover 19. The foot pedal 25 is pivotally supported by the shaft 15 passing through the holes 28*a* and 28*b* of the rise portions 21*a* and 21*b* and biased in the clockwise direction by a coil spring 31 would on the shaft 15. At the lower end on the mounting part 26, an end of a lever 29 of an insulating material is supported rotatably. The other end of the lever 29 is inserted into and held in engagement with the hole 13 of the conductor plate 14. The raised portion 12 of the conductor plate 14 is connected with a terminal 30*b* of the lead wire 30.

Figure 2:
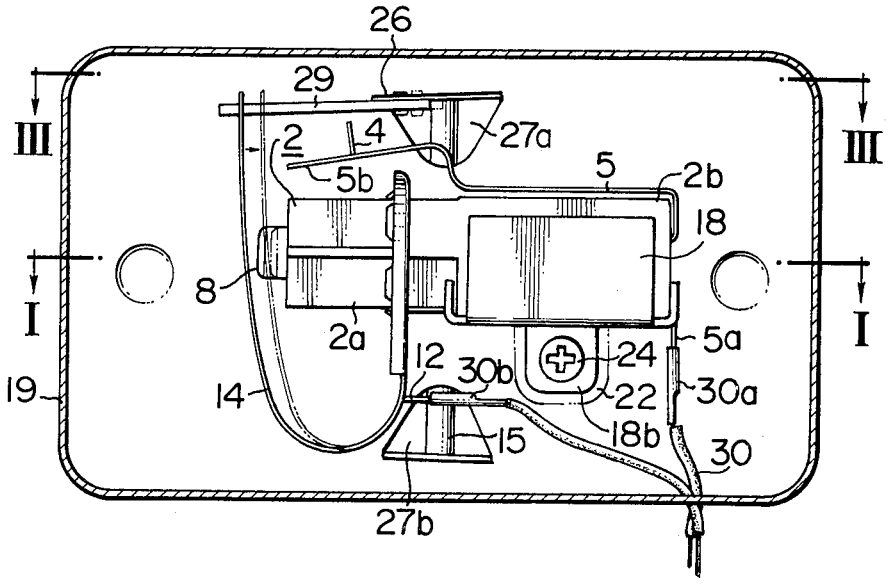
FIG. 2 is the controller of FIG. 1 as viewed from the bottom thereof.
Figure 3A:
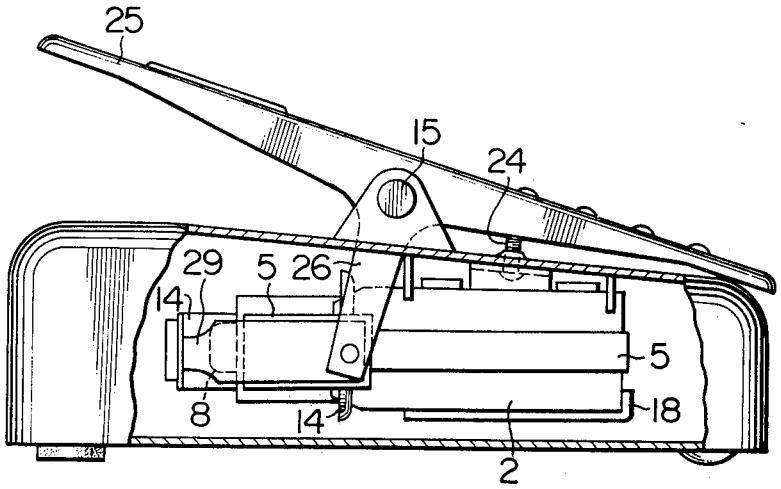
FIGS. 3A and 3B are diagrams for explaining the operation of the controller shown in FIG. 1.
Figure 3B:
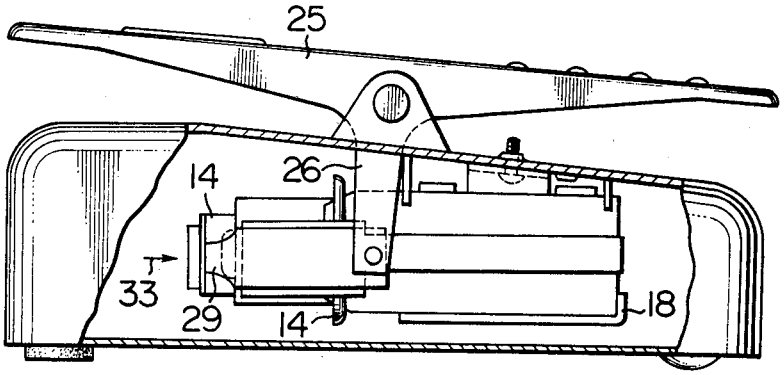

The operation of the controller having this construction will be explained below with reference to FIGS. 3A and 3B, which are longitudinal sectional views of the controller taken along the line III—III in FIG. 2. Under the condition where no force is exerted on the foot pedal 29, the controller is in the condition shown by FIG. 3A and the solid line in FIG. 2. Under this conditions, the conductor plate 14 fails to contact the tappet 8 and the resistance between the terminals 30*a* and 30*b* is infinitely large. At the press of the foot pedal 29, the foot pedal 29 rotates in the counterclockwise direction as shown in FIG. 3B, so that the mounting part 26 is also rotated in the counterclockwise direction. The lever 29 moves in the direction of arrow 33. The part 14*b* of the conductor plate 14 engaged in the hole 13 of the mounting part 29 is also moved in the direction of arrow 33, so that the conductor plate 14 comes into contact with the tappet 8. As a result, a current flows between the terminals 30*a* to 30*b* through the conductor plate 14, the carbon pile resistor, and the tappet 8 so that the resistance value between the terminals 30*a* and 30*b* is equal to the resistance of the carbon pile resistor. With the further increase in pressing force on the foot pedal 25, the lever 29 is moved rightward further. The pressure on the tappet 8 by the conductor plate 14 increases, and the conductor plate 14 and the tappet 8 take the condition as shown by dotted lines in FIG. 2, so that the resistance value of the carbon pile rheostat is decreased.

When the pressure on the foot pedal 25 is further increased, the conductor plate 14 is brought into contact with the end 5*b* of the conductor plate 5, with the result that the terminals 30*a* and 30*b* are shorted each other.

With the release of the pressure on the foot pedal 25, the conductor plate 14 is restored to original state. The conductor plate 14 leaves from the tappet 8 and the resistance of the carbon pile rheostat becomes maximum.

When the rotational plate 25 rotates, the resistance value of the carbon pile rheostat changes as a function of the bias of the rotational plate 25. It is thus possible to control the speed of the motor according to the bias of the rotational plate 25.

The raised portion 4 of the conductor plate 5 is for keeping the lever 29 and the end 5*b* of the conductor plate 5 in spaced relation with each other.

It will be seen from the foregoing description that the carbon pile controller according to the present invention comprises the single insulating frame 2, the shorting conductor plate 5, the conductor plate 14, the tappet 8 adapted to be pressed by the conductor plate 14, and the holder 18 for securely mounting the insulating frame 2 within the cover. Because of this simple construction, the controller according to the present invention has the various advantages including the ease in assembling the controller with a considerably low cost.

I claim:

1. A controller for electric motors comprising:

a casing;

a carbon pile resistor contained within a through-hole of an insulating frame carried by said casing;

a U-shaped spring conductor plate with an end secured to said insulating frame;

a rotational plate pivotally supported on said casing;

a first terminal connected to an end of said carbon pile resistor; and a second terminal connected to said conductor plate;

wherein the other end of said conductor plate is operatively coupled to said rotational plate, and is biased in response to the rotation of said rotational plate, for pressing the other end of said carbon pile resistor; and an arm member of an insulating material having one end pivotally supported on said rotational plate and the other end operatively coupled to said conductor plate, said arm member being adapted to move in the longitudinal direction of said carbon pile resistor in response to the rotation of said rotational plate, thereby moving the other end of said conductor plate in the same direction for pressing said carbon pile resistor.

2. A controller according to claim 1, further comprising a conductor strip having one end connected to said one end of said carbon pile resistor, the other end of said conductor strip being brought into contact with the other end of said conductor plate when said rotational plate rotates by a predetermined angle and the pressure exerted by said conductor plate on said carbon pile resistor reaches a maximum.

3. A controller according to claim 2 wherein said one end of said conductor strip is fixedly inserted in a recess in said through hole of said insulating frame.

4. A controller according to claim 1 wherein said conductor plate is provided with an aperture at said one end thereof, said insulating frame being fixedly inserted in said aperture of said conductor plate.

5. A controller according to claim 4 wherein said conductor plate is provided with raised portions around said aperture and said insulating frame has a recess for fixedly engaging with said raised portions.

* * * * *